US005866978A

United States Patent [19]

Jones et al.

[11] Patent Number: 5,866,978

[45] Date of Patent: Feb. 2, 1999

[54] MATRIX GETTER FOR RESIDUAL GAS IN VACUUM SEALED PANELS

[75] Inventors: Gary W. Jones, Lagrangeville; Amalkumar P. Ghosh, Poughkeepsie; Steven M. Zimmerman, Pleasant Valley; Munisamy Anandan, Fishkill, all of N.Y.

[73] Assignee: Fed Corporation, Hopewell Junction, N.Y.

[21] Appl. No.: 941,078

[22] Filed: Sep. 30, 1997

[51] Int. Cl.[6] ..... H01J 1/62

[52] U.S. Cl. ..... 313/495; 313/481; 313/546; 313/547; 313/549; 313/553; 313/558; 313/561

[58] Field of Search ..... 313/481, 546, 313/547, 549, 553, 558, 561; 445/24, 41

[56] References Cited

U.S. PATENT DOCUMENTS

| | | | |
|---|---|---|---|
| 4,925,741 | 5/1990 | Wong | 428/661 |
| 5,223,766 | 6/1993 | Nakayama et al. | 313/495 |
| 5,311,104 | 5/1994 | Antle . | |
| 5,312,607 | 5/1994 | Schiabel et al. . | |
| 5,396,150 | 3/1995 | Wu et al. . | |
| 5,442,193 | 8/1995 | Jaskie et al. . | |
| 5,453,659 | 9/1995 | Wallace et al. | 313/495 |
| 5,491,376 | 2/1996 | Levine et al. . | |
| 5,514,618 | 5/1996 | Hunter, Jr. et al. . | |
| 5,520,563 | 5/1996 | Wallace et al. | 445/24 |
| 5,614,785 | 3/1997 | Wallace et al. | 315/496 |
| 5,689,151 | 11/1997 | Wallace et al. | 313/495 |
| 5,693,438 | 12/1997 | Liu et al. | 430/28 |
| 5,731,660 | 3/1998 | Jaskie et al. | 313/495 |
| 5,734,226 | 3/1998 | Cathey | 313/553 |

*Primary Examiner*—Sandra L. O'Shea
*Assistant Examiner*—Matthew J. Gerike
*Attorney, Agent, or Firm*—Collier, Shannon, Rill & Scott, PLLC

[57] ABSTRACT

An integral and internal matrix getter structure for capturing residual gas in a vacuum sealed container is disclosed. The vacuum sealed container may be a flat panel display having a small vacuum gap between two closely spaced panels. The getter structure may be provided on the inside of the walls of the display. In particular, the getter structure may be provided between phosphor groups and/or between field emitter groups on the display panels. The getter structure may be sealed to avoid exposure of the getter material until after a vacuum condition is reached within the display. Activation of the getter structure may be provided by selectively heating the getter structure with a laser or with resistive heating elements underlying the getter structure. Methods of making the getter structure are also disclosed.

46 Claims, 5 Drawing Sheets

MATRIX GETTER FOR RESIDUAL GAS IN VACUUM SEALED PANELS

FIELD OF THE INVENTION

The present invention relates to methods and apparatus for capturing gas in a vacuum sealed chamber with a getter. In particular the present invention relates to capturing gas in flat panel displays with a getter.

BACKGROUND OF THE INVENTION

Microminiature field emitters are well known in the microelectronics art. These microminiature field emitters are finding widespread use as electron sources in microelectronic devices. For example, field emitters may be used as a source of electrons in electron guns employed in flat panel displays for use in aviation, automobiles, workstations, laptop computers, head mounted displays, head-up displays, outdoor signage, or practically any application for a screen which conveys information through light emission.

When used in a display, the electrons emitted by a field emitter are directed to a cathodoluminescent material. These display devices are commonly called Field Emission Displays (FEDs). A field emitter used in a display may include a microelectronic emission surface, also referred to as a "tip" or "microtip". An extraction electrode or "gate" may be provided adjacent, but not touching, the field emission tip, to provide a field emission gap therebetween. Upon application of an appropriate voltage between the emitting electrode and the gate, quantum mechanical tunneling, or other known phenomena, cause the tip to emit electrons. The emitted electrons are then accelerated towards the anode. In microelectronic applications, an array of field emission tips may be formed on the horizontal face of a substrate such as a silicon semiconductor substrate. Emitting electrodes, gates and other electrodes may also be provided on or in the substrate as necessary. Support circuitry may also be fabricated on or in the substrate.

The electrical theory underlying the operation of an FED is similar to that for a conventional CRT. Electrons emitted from the tips are accelerated by the gate and anode in the direction of the display surface. These high energy electrons strike phosphors on the inside of the display and excite them to luminesce. The phosphor targets may be arranged in pixels to facilitate the formation of an image. An image is produced by the pattern of luminescing phosphor pixels as viewed by an observer on the display screen. This process is a very efficient way of generating a lighted image.

In a CRT, one electron gun for monochrome or three electron guns for color are provided to generate all of the electrons which impinge on the display screen. A complicated deflection device, usually comprising high power electromagnets, is required in a CRT to direct the electron stream towards the desired screen pixels. The combination of the electron gun and deflection device behind the screen necessarily make a CRT display prohibitively bulky.

FEDs, on the other hand, are relatively thin. Each pixel of an FED has its own electron source, typically an array or group of emitting microtips. The high electric field between the cathode and the gate causes electrons to be emitted from the microtips. FEDs are thin because the microtips, and gates, which are the equivalent of an electron gun in a CRT, are extremely small. Further, an FED does not require a deflection device, because each pixel has its own electron gun (i.e. gate and emitters) positioned directly behind it. The emitters need only be capable of emitting electrons in a direction generally normal to the FED substrate and towards the anode.

With reference to FIG. 1, a cross-section of the edge of a typical FED 10 is illustrated. The FED may include a lower field emitter panel 100, and an upper display panel 200. The field emitter panel 100 may include a glass substrate 110 on which field emitter groups 120 are formed. Each field emitter group 120 may include tens, hundreds, or even thousands of individual emitter tips 122.

The upper display panel 200 may include a glass substrate 210 on which a multiplicity of phosphor groups 220 are formed. Each phosphor group may include many individual phosphor grains 222 which luminesce when electrons from the emitter groups 120 strike them. Each phosphor group 220 may correspond to a pixel in the FED 10. The emitter groups 120 and the gate 130 constitute the "electron guns" which shoot streams of electrons towards the pixels, causing them to fluoresce. The electrons may be made to bombard the phosphor groups 220 by providing the upper display panel 200 with a highly positively charged anode 230. Typically the anode 230 may be provided by a thin layer of metal over (or optionally by a transparent conductor layer 235 under) the phosphor particle groups 220. The anode 230 may be maintained at a potential hundreds or thousands of volts above that of the field emitter groups 120.

The lower field emitter panel 100 and the upper display panel 200 may be connected to each other around their respective perimeters by a side spacer 300 through a glass frit 310 which is adhered to the lower panel 100 and the upper panel 200. The inner side of the glass frit 310 may be coated with a getter layer 320. The getter layer 320 may be used to capture gas molecules which may be present within the FED. The getter layer 320, and its relevance to the present invention are explained in greater detail below.

With reference to FIG. 2*a*, a plan view of several emitter groups 120 are shown as arranged on the lower field emitter panel 100. The cross section A—A identified in FIG. 2*a* can be viewed in detail in FIG. 1. Each emitter group 120 includes a multiplicity of individual emitter tips 122. Each group 120 may contain hundreds or even thousands of individual emitter tips 122. Only nine emitters are shown per group in FIG. 2*a* for ease of illustration. The field emitter groups 120 may be arranged in parallel rows, with one gate line 130 serving each row of emitter groups. In between the gate lines 130 there is a gap 140. The getter layer 320 is present only along the inside wall of the glass frit 310.

With reference to FIG. 2*b*, a plan view of several phosphor groups 220 formed on the inner surface of the upper display panel 200 is shown. The anode which lies over or under the phosphor groups 220 is not shown in this Figure. Each of the phosphor groups 220 may correspond to one of the field emitter groups 120 shown in FIG. 2*a*. The area between the phosphor groups 220 may comprise glass substrate 210 (shown) or the anode (not shown). The area between the phosphor groups 220 may form a grid or matrix 240 depending on the arrangement of the phosphor groups 220 on the glass substrate 210. The getter layer 320 is present only along the inside wall of the glass frit 310.

With renewed reference to FIG. 1, in order to operate a display, the space between the lower field emitter panel 100 and the upper display panel 200 should be evacuated. Typically, this space may be of the order of a 1 millimeter separation. As noted above, the glass substrate 110 underlying the field emitter groups 120 and the glass substrate 210 supporting the phosphor groups 220 may be sealed to one another along their respective edges with the glass frit 310, encompassing a spacer 300. After being sealed, the space between the two glass substrates, 110 and 210, may be evacuated of gas and sealed off from the outside atmosphere.

Residual gas on, in, or above the surfaces of two glass substrates, 110 and 210, can increase the probability of electric flash-overs. It is very common for residual gas to be absorbed into the metal or other interior surfaces of an FED during processing. Once the interior of the FED is evacuated, these absorbed gases tend to outgas into the interior of the FED. A residual gas molecule may typically adhere to an interior surface of the FED, float away until it strikes another surface, adhere to the new surface for a while, etc. Because the interior space of an FED is a relatively long narrow space, the gas molecules, depending on the mean free path, collide with the walls and between themselves with a maxwellian distribution of velocities. During this random movement, some of the molecules may arrive at the perimeter of the FED panel and strike the surface of the getter. As the getter acts as a chemical pump, the local pressure in the vicinity of the getter surface may fall. This may set up a pressure gradient between the bulk of the space in the FED and the space close to the getter surface. Thus a directed flow of gas molecules towards the getter takes place.

If the getter capacity is limited, there may arise a situation of net increase in the population of residual gas molecules in the panel space and the gas population may further increase due to the desorption of gas molecules from the surfaces of interior structures.

The accumulated gas molecules in the FED may become easily ionized due to the high energy electrons within the FED. With continued reference to FIG. 1, the ionized gas molecules may provide an electrical path for flash-overs between adjacent gate lines 130, between emitter tips 122 and gates lines 130, and even between gate lines 130 and the anode 230. Flash-overs can damage or destroy an FED. In FEDs in which the potential between the anode 230 and the gate lines 130 is in the range of thousands of volts, flash-over may be catastrophic to the device 10. Therefore, it is imperative to reduce the amount of residual gases within the FED as much as possible. Even if a flash-over is not initially catastrophic, it may result in overheating of the materials within the FED, resulting in the release of additional gas molecules thereby enhancing the probability of future flash-over.

One method of addressing the residual gas problem in displays has been to capture the gas in a getter located within the display. CRTs typically include a getter consisting of a wire or ring of chemically reactive metals covered with a passivation layer of a material than can be thermally disrupted to expose the chemically reactive material after the display has been assembled and evacuated.

Jones, U.S. Pat. No. 5,534,743 (Jul. 9, 1996) for Field Emission Display Devices, and Field Emission Electron Beam Source and Isolation Structure Components Therefor, herein incorporated by reference, discloses a getter arrangement for use in an FED. The '743 patent discloses a flat panel display assembly having an extension portion defining an extension volume in which a getter capsule containing an active getter may be disposed. The getter may be chemisorptively effective for removal of gases in the interior volume of the display.

Previous attempts to control flash-over by capturing gas within an FED have consisted of placing a layer of getter material along the inside of the outer perimeter wall joining the two flat panels of the display. With continued reference to FIG. 1, a getter 320 may be provided along the outer perimeters of the glass substrates, 110 and 210, and/or along the inside of the glass frit 310. A resistive heating element 330 may be provided under the getter 320, and a protective coating 340 provided over the getter. An example of a known getter is described in an article entitled "An updated review of getters and gettering" by T. A. Girogi et al., published in J. Vac. Sci. Technol. A 3(2). (March/April, 1985).

Space requirements have largely dictated the location of the getter material. With reference to FIG. 3*a,* a resistive heating element 330 may be provided along the upper or lower substrate 110 or 210. The getter 320 may be provided over the resistive heating element 330, and a protective coating 340 is provided over the getter. The getter and the protective coating may be applied under vacuum, so that the getter does not come into contact with any gas before being sealed by the protective coating. After the FED has been evacuated and sealed, the resistive heating element 330 is heated. With reference to FIG. 3*b,* the heat from the resistive heating element causes the protective coating 340 to melt (and not the getter 320) and at least partially exposes the getter 320 to the vacuum within the FED. As gas molecules are released from the internal surfaces of the FED over time, the getter 320 may be able to absorb the gas and prevent flash-overs.

As noted above, released gas molecules may spend the majority of their time in the FED and may adhere to an inner surface of the FED. The probability of flash-over may be greatly reduced by reducing the residual gas molecules on the inner FED surfaces. Residual gas can support pre-ionization under high voltages and eventually lead to arc discharge (flash-over). Minimizing the residual gas molecules, and thus preventing flash-overs (arcs), is difficult in a FED because of the high fields existing at the sharp tips and the gates.

The gases desorbed from the interior FED surfaces wander about at random with speeds characterized by the temperature of the gas. As stated previously, the gas molecules collide among themselves and with the walls in which they are contained. If a getter is located at the perimeter of the display, the chemi-sorption of gases at the getter site results in a directed flow of gases from the center of the panel space to the getter site.

The number of collisions the gas molecules make with the walls of the interior FED surfaces will be characterized by the magnitude of the mean free path in relation to the dimensions of the structures. Every time a gas molecule collides with a wall, the chances of its retention at the wall (physi-sorption) depends on the sticking coefficient. The sticking coefficient may vary with the nature of the gas species and the nature of the material with which the gas molecule collides. Obviously the sticking coefficient will vary for the surfaces of a microtip, gate metal, phosphor, etc. Before the gas molecules find their way to the getter, a number of complex collision mechanisms occur. These mechanisms dictate the time spent by the gas molecules in the panel space before they arrive at the getter site. Obviously, the larger the panel size, the longer the transit time of the gas molecules to the getter site. It may take a week to establish the equilibrium pressure at which the residual gas is drawn to the perimeter getter. If the panel is operated before this equilibrium is reached, flash-overs may become imminent. To reduce this long transit time, Applicants have developed "on-site gettering" inside the panel. This getter for the gas molecules is provided in the region that the gas molecules are desorbed instead of being provided at the perimeter of the panel where the gas must drift to the getter. This leads to an improved apparatus and method of "on-site gettering" of residual gases inside an FED which may reduce the occurrence of flash-overs.

OBJECTS OF THE INVENTION

It is therefore an object of the present invention to provide methods and apparatus for reducing the likelihood of flash-overs in a flat panel display by reducing the amount of residual gas therein.

It is another object of the present invention to provide methods and apparatus for reducing the average length of time required to capture a residual gas molecule in a flat panel display.

It is a further object of the present invention to provide methods and apparatus for reducing the average distance a residual gas molecule must travel to reach a getter in a flat panel display.

It is still another object of the present invention to provide methods and apparatus for providing a getter structure along the inner surfaces of the flat panels of a flat panel display.

It is yet another object of the present invention to provide methods and apparatus for activating a getter structure located along the inner surfaces of the flat panels of a flat panel display.

It is still a further object of the present invention to provide methods of assembling a getter structure in a flat panel display.

It is still another object of the present invention to provide methods and apparatus for improving getter activation in a flat panel display.

It is still another object of the present invention to provide methods and apparatus for extending the average lifespan of a flat panel display.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative and economical vacuum sealed field emitter display having a first panel connected to a second panel with a perimeter sealing means and having an internal getter, comprising the improvement of a means for activating said getter provided between active elements of said first or second panel; and a layer of getter material overlying said means for activating.

Applicants have also developed an innovative and economical method for use in a vacuum sealed display having a first panel connected to a second panel with a perimeter sealing means, an internal getter, means for activating said getter provided between active elements of said first or second panel, and a protective layer overlying said getter, wherein the method of activating said getter comprises the step of: selectively applying energy from an external source to said activating means such that said protective layer is disrupted without disrupting the getter by the application of energy and the getter is exposed to the vacuum within said display.

Applicants have further developed a method of forming a sealed getter layer overlying a flat panel of a display, comprising the steps of: providing a thermal activation array on said flat panel; providing a layer of getter material over said thermal activation array; and providing a layer of protective material over said getter material such that said getter material is encapsulated in said protective material.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 4A:
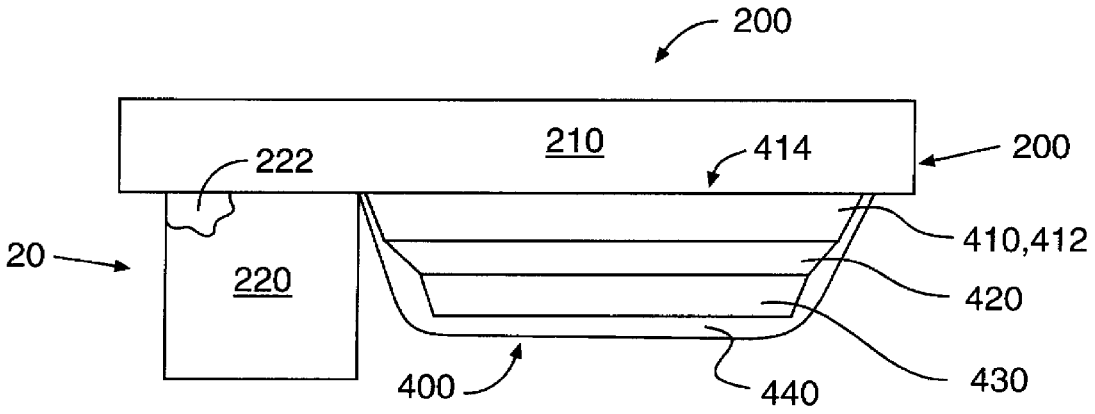
FIG. 4*a* is a cross-sectional view in elevation of an embodiment of the invention formed on a front panel of a FED.

Reference will now be made in detail to a preferred embodiment of the present invention, an example of which is illustrated in the accompanying drawings. A preferred embodiment of the present invention is shown in FIG. 4*a*.

The front display panel 200 may include a substrate 210, on which an active FED element 220 and a getter structure 400 are provided. The getter structure 400 may include a means 410 for activating getter material 420–430, and a means 440 for protecting the getter material 420–430. The getter structure may be activated by raising the temperature of the activating means 410 which causes the protecting means 440 to melt or rupture. The disruption of the protecting means 440 results in the getter material 420–430 being activated and exposed to the interior of the FED and allows the getter to capture residual gas in the FED.

A more detailed embodiment of the invention may also be explained with reference to FIG. 4*a*. The display panel 200 may include multiplicity of phosphor groups 220 spaced apart from one another on a glass substrate 210. Each phosphor group 220 may comprise a plurality of individual phosphor grains 222. The phosphor groups 220 may be spaced into a matrix, such that each phosphor group 220 constitutes an individual pixel in the display panel 200.

Intermediate of the phosphor groups 220 may be a multilayered getter structure 400. The getter structure 400 may include a layer of material 410 for activating the getter structure on the glass substrate 210. The activating means 410 may be provided by any means capable of heating up under the influence of an energy source external to the FED. First and second layers of getter material, 420 and 430, may be provided on the activating means 410. A protective overcoat layer 440 may encapsulate the first and second layers of getter material, 420 and 430, within the multilayered getter structure 400.

The operation of the getter structure 400 may be as follows. The protective overcoat layer 440 may isolate the first and second layers of getter material, 420 and 430, from the atmosphere, whether it be the atmosphere within the FED or any other atmosphere. Since the first and second layers of getter material are isolated, they are not able to absorb any gas molecules, and accordingly their absorption capacity is conserved, even after the frit seal, until the interior of the FED is evacuated. Once the interior of the FED is evacuated of as much gas as possible, the getter structure 400 may be activated. The activating means 410 may be caused to heat up using an energy source which is external to the FED. The heat delivered by the layer 410 may cause the protective overcoat layer 440 to melt or disrupt such that it no longer isolates the first and second layers of getter material, 420 and 430, from the atmosphere within the FED. The heat delivered may also need to be sufficient to bring the chemically reactive getter material to the surface of the getter structure 400. The temperature required to activate the getter structure 400 must be greater than any of the temperatures reached during the prior processing steps to insure that the getter material is not exposed until the vacuum pumping of the FED is completed. After activation, the first and second layers of getter material may then absorb residual gas in the FED, and absorb gas which is outgassed over time from the FED constituent. Because the multilayed getter structure 400 may be dispersed over the inner surface of the display panel 200, gas molecules are likely to be absorbed in the getters much sooner than if the getters were only provided at the outer perimeter of the display panel.

A first preferred example of the activating means may be provided by a layer of light absorptive material 412. The light absorptive material 412 may be heated by directing a laser beam or high intensity flashlamp light through the glass substrate 210 onto the back surface 414 of the light absorptive layer 412. If a laser is used, the beam may be raster scanned over the outside of the display panel to activate an array of spots or lines between the pixels of the display panel. An exemplary laser is an Argon ion laser providing about 1 Watt of power and a scan rate of 1 mm–1 cm/cc wavelength of the laser may be so chosen that it has minimal absorbtion in the FED substrate glass and a high absorbtion in the material to be heated.

The light absorptive layer 412 may comprise an element, compound, or mixture, such as a mixture of chromium (Cr) and silicon oxide (SiO). An exemplary light absorptive layer 412 may comprise a 600 nanometer thick layer of 50 weight percentage Cr and SiO mixture. The weight percentage mixture of Cr and SiO may be varied to provide selective levels of light absorption. Alternative materials for the light absorptive layer include titanium oxide, graphite, and manganese dioxide.

Figure 6:
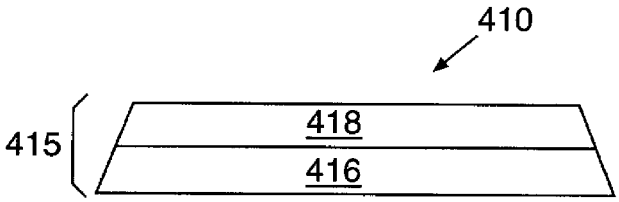
FIG. 6 is a cross-sectional view in elevation of a thermal energy delivery element of an alternative embodiment of the invention.

With reference to FIG. 6, the activating means 410 may alternatively be provided by a resistive heating element 415, or an array of such heating elements. The resistive heating element may be provided by a resistive material which may be connected to a current source (not shown). Resistance in the element 415 to the passage of current through the element results in the element heating up to provide the function of an activating means. In a preferred embodiment of the resistive heating element 415, the element is provided by a lower layer of light absorptive material 416 and an upper layer of resistive material 418. The layer of light absorptive material 416 may be provided on the inside of the glass substrate (not shown). The layer of light absorptive material provides a dark frame around each pixel in the display which may enhance the overall appearance of the display. Exemplary resistive material which may be used to provide the resistive heating element 415 include graphite or Cr+SiO (50% by weight), for example.

With renewed reference to FIG. 4*a*, and as described above, the getter structure 400 may include first and second layers of getter material, 420 and 430. Although two layers of getter material are shown in the preferred embodiment of FIG. 4*a*, in alternative embodiments only one layer of getter material may be provided, or more than two layers of getter material may be provided.

The getter materials may comprise chemically reactive materials capable of absorbing residual gases when exposed to gas molecules in the FED. The getter materials may preferably be capable of absorbing oxygen, hydrogen, nitrogen, water vapor, sulfur oxides, carbon dioxide, methane, and/or carbon monoxide. Because the reactivity of many of the gases may be enhanced by the presence of ionizing electron beams within the FED, the number of getter material choices may be significantly increased. Mixtures of metals may provide a larger absorption range of chemicals than most single materials. An exemplary getter alloy may comprise a co-evaporated 400 nanometer thick film of: 30% by weight titanium, 10% by weight barium, 10% by weight iron, and 50% by weight zirconium.

Many variations of the foregoing alloy, as well as other alloys, may be used as the getter materials for the invention. Furthermore, the foregoing alloy, as well as others, may be deposited as a mixture or by depositing layers of the individual components of the mixture. If the getter alloy is deposited as more than one layer of individual components, the layers may be mixed together as a result of the heat activation of the activating means 410. One criteria for the getter material selected is that it should be resistant to the release of absorbed gases when exposed to the planned level of electron bombardment within the FED. Examples of alternative getter materials include an alloy of zirconium, titanium and nickel, or Zr-Al or Ti-Th-Zr or Zr-V-Fe.

In an alternative embodiment, in which multiple layers of reactive materials are employed to absorb and getter reactive gases, the getter layers may exothermically react with each other to enhance the heat activation process of the getter structure. An example of an exothermically reactive getter starting from the glass substrate 210 may include a lower layer of potassium chromate, and an upper layer of an iron/zirconium mixture. Heating of the multiple layers of reactive material may initiate a chemical reaction which lowers the activation temperature threshold and better insures full activation of the getter material. Alternative exothermic multiple layer reactive material getters may include Zr-Al and NiO.

With continued reference to FIG. 4*a*, the protective overcoat layer 440 may be provided by a layer of aluminum, chromium, silicon, or materials with similar melting temperatures. In a preferred embodiment, layer 440 may be in the range of 100–200 nanometers thick. Preferred methods of applying layer 440 are those which result in an encapsulation of the getter layers, 420 and 430. Encapsulation may best be achieved with deposition processes such as a sputtering process, or a chemical vapor deposition process, although an evaporation process may also be employed.

A preferred protective overcoat layer 440 may be provided by a 200 nanometer thick layer of aluminum, which may form an outer coating of aluminum oxide. The aluminum layer provides a relatively low melting point material, which reduces the level of thermal energy delivery which is required of the activating means 410 in order to activate the getter structure 400. Moreover, once the passivating outer coating of aluminum oxide is melted, the substantially pure aluminum layer may be exposed to the interior atmosphere of the FED. Since aluminum may be chemically reactive to many of the gases which need to be absorbed in the FED, the protective overcoat layer 440 may itself provide a getter material after thermal activation of the getter structure 400.

Figure 1:
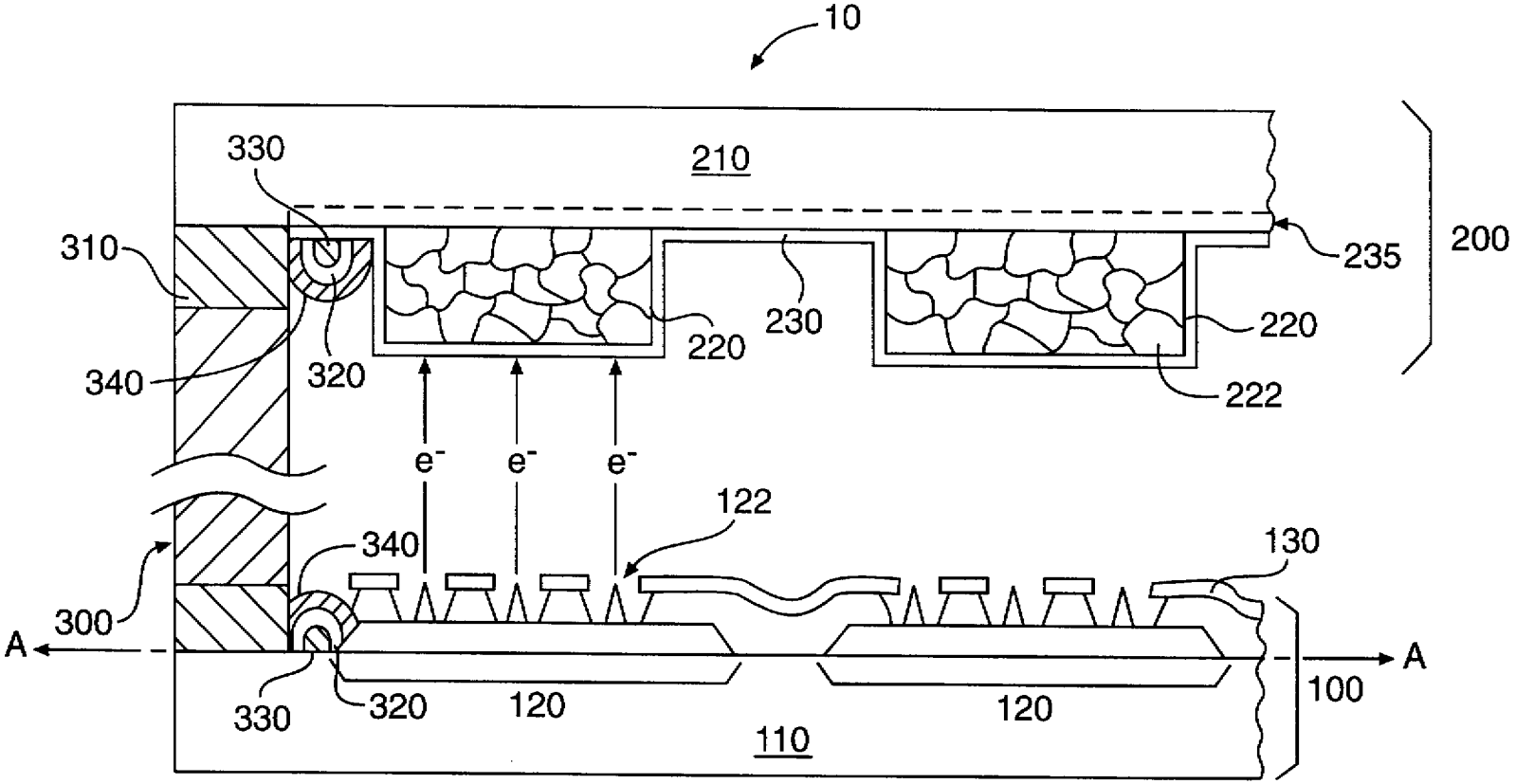
FIG. 1 is a cross-sectional view in elevation of an edge portion of a FED.
Figure 2A:
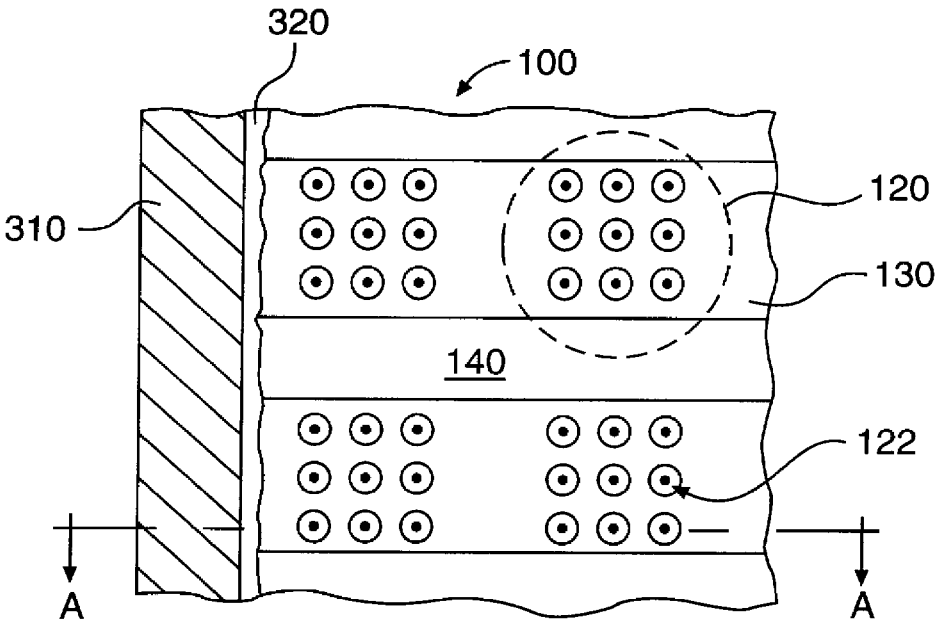
FIG. 2*a* is a top plan view of an edge portion of a field emitter panel of a FED.
Figure 2B:
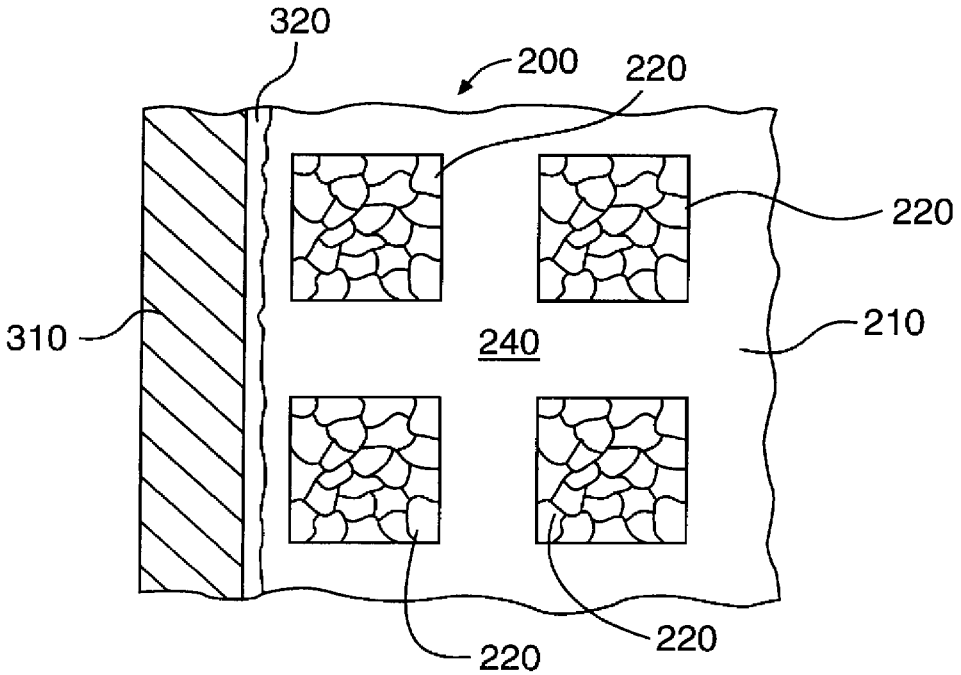
FIG. 2*b* is a bottom plan view of an edge portion of the front panel of a FED.
Figure 3A:
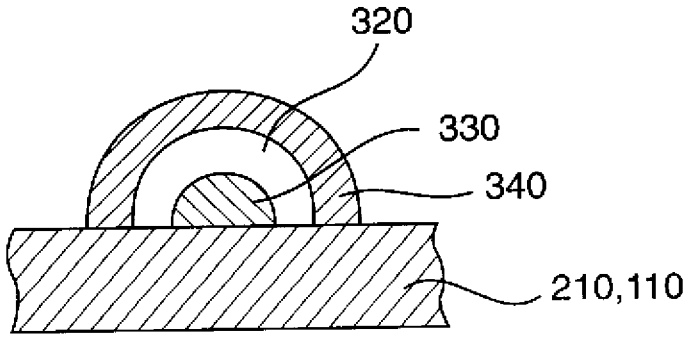
FIG. 3*a* is a cross-sectional view in elevation of a getter structure prior to activation.
Figure 3B:
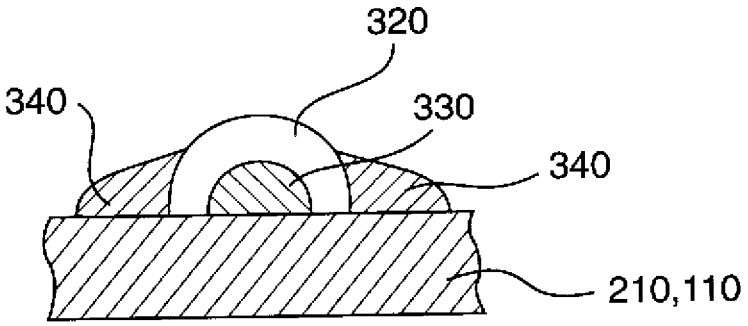
FIG. 3*b* is a cross-sectional view in elevation of a getter structure after activation.

The pattern of the getter structure 400 on the glass substrate 210 may take one of many different forms. With reference to FIG. 2*b*, the getter structure may, for example, be provided in all of, or part of, the grid or matrix 240. The getter structure may be provided as a continuous criss-cross matrix between the phosphor groups 220, or as patches or dots of getter structure arranged on the matrix 240. Since the matrix 240 may be continuous over the inner surface of the display panel 200, the getter structure may be advantageously dispersed over the surface of the display panel.

Figure 4B:
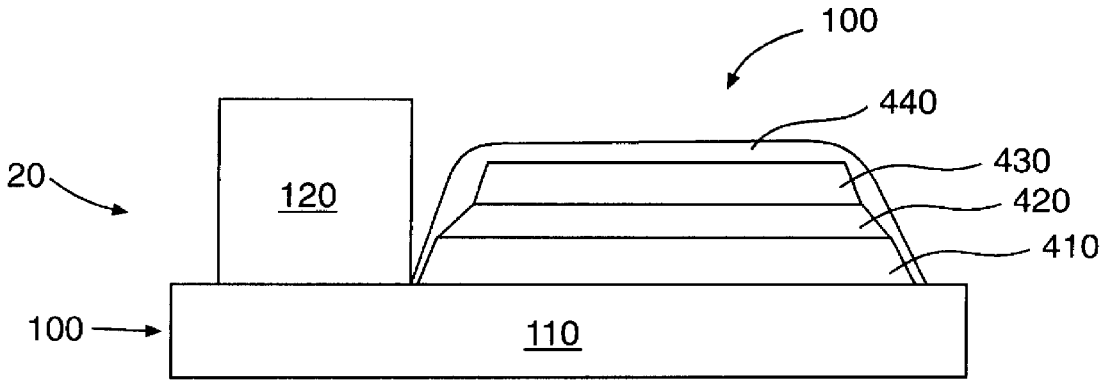
FIG. 4*b* is a cross-sectional view in elevation of an embodiment of the invention formed on a back panel of a FED.

With reference to FIG. 4*b*, the getter structure 400 may also, or in the alternative, be provided on a field emitter panel 100. If the activating means 410 used is laser or xenon flashlamp activated, the glass substrate 110 should be transparent to such laser or flashlamp light. If the activating means 410 is provided by a resistive heating element, then the glass substrate need not be transparent.

The pattern of the getter structure 400 on the glass substrate 110 of the field emitter panel 100 may take one of many different forms. With reference to FIG. 2*a*, the getter structure may, for example, be provided in all of, or part of, the rows or matrix 140. The getter structure may be provided as a continuous strip of material between the field emitter groups 120, or as patches or dots of getter structure arranged on the rows 140. Since the rows 140 may run across the entire inner surface of the field emitter panel 100, the getter structure may be advantageously dispersed over the surface of the field emitter panel.

Figure 5A:
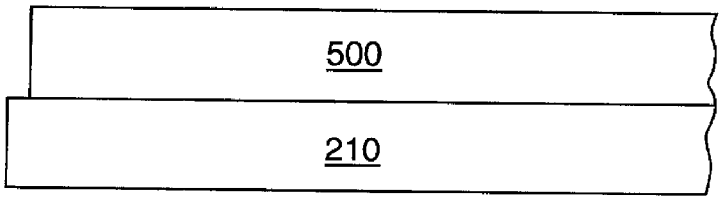
FIGS. 5*a*–5*d* are cross-sectional views in elevation of a FED during the progressive steps of a method, embodiment of the invention.

A preferred method of making an embodiment of the invention may be explained with reference to FIGS. 5*a*–5*d*, inclusive. With reference to FIG. 5*a*, the method may be initiated by providing a glass substrate 210 with a layer of photoresistive material 500. The photoresistive material may be any of the conventionally available positive or negative resists used for device processing.

Figure 5B:
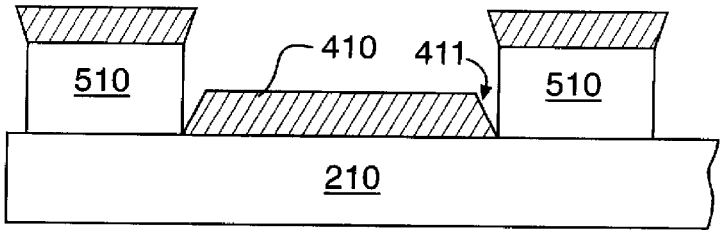

With reference to FIG. 5*b*, the layer of photoresistive material may be masked, exposed to light, and washed so that photoresistive islands 510 remain. Following the washing away of the exposed (or unexposed) regions of the photoresistive material 500, the glass substrate 210 may have large numbers of the photoresistive islands 510 dispersed on its surface. If the glass substrate 210 is to be used for a display panel, the photoresistive islands 510 may correspond with the shape and footprint of the phosphor groups 220 shown in FIG. 2*b*. If the glass substrate 210 is to be used for a field emitter panel, the photoresistive islands 510 may correspond with the shape and footprint of the gate lines 130 shown in FIG. 2*a*.

With continued reference to FIG. 5*b*, an activating means 410 may be provided on the upper exposed surfaces of the photoresistive islands 510 and the glass substrate 210. If the activating means 410 comprises light absorptive material, then the layer 410 may preferably be provided by evaporating a layer of a chromium and silicon oxide mixture onto the islands and substrate. The evaporation of the light absorptive material may be carried out at a selective angle of incidence to the glass substrate 210, such that the activating means forms an inwardly beveled edge 411. Alternatively, the activating means 410 may be sputtered or applied using chemical vapor deposition.

Figure 5C:
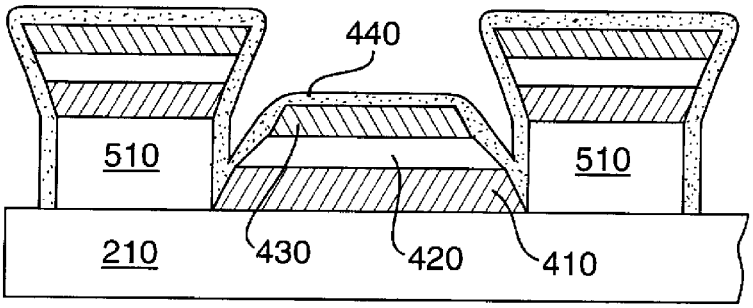

With reference to FIG. 5*c*, first and second layers of getter material, 420 and 430, may next be provided on the upper exposed surfaces of the activating means 410. The one or more layers, 420 and 430, may preferably be provided by evaporating a layer of a metal alloy comprising metals such as titanium, iron, and zirconium, onto the activating means 410. The evaporation of the getter material(s) may be carried out at a selective angle of incidence to the glass substrate 210, such that the layers of getter material, 420 and 430 form inwardly beveled edges. Alternatively, the getter materials may be sputtered or formed by chemical vapor deposition, depending upon the individual getter materials employed.

Following the formation of the one or more layers of getter material, a protective overcoat layer 440 may be provided on the exposed surfaces of the layers of getter material, 420 and 430, and on the activating means 410. The protective overcoat layer 440 may preferably be deposited using a more conformal process than the preceding depositions (e.g., if the preceding layers were deposited using evaporation, then the protective overcoat layer 440 may be sputtered to completely encapsulated the other layers). The protective overcoat layer 440 should be deposited before there is any extensive exposure of the lower reactive film to reactive gases such as air.

Figure 5D:
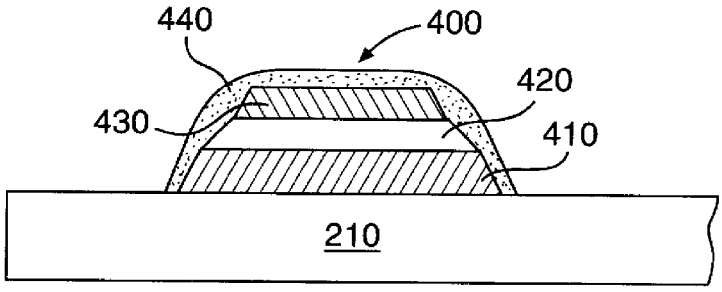

With reference to FIG. 5*d*, the getter structure 400 is formed by the removal of the photoresistive islands 510 and the material layers overlying the islands. The removal process is initiated by a 80 deg C NMP (n-methyl pyrilidene). The NMP may be followed by an alcohol rinse which may be used to liftoff the photoresistive islands 510, leaving the getter structure 400 on the glass substrate 210. Following the formation of the sealed getter structure 400, a phosphor group (not shown) or a field emitter group (not shown) may be formed in the areas adjacent to the getter structure. When the getter structure 400 is formed before phosphor processing or field emitter processing, the protective overcoat layer 440 should be resistant to the patterning chemistry used to form the phosphor groups or field emitter groups. In alternative embodiments of the invention, the getter structure 400 may be formed after phosphor groupings or field emitter groupings are formed on the glass substrate 210.

In other embodiments of the invention, the getter structure 400 may be activated while the FED is still connected to a vacuum pump to permit outgassing from the getter structure and glass surfaces and subsequent activation of the getter structure. Once the FED is finally sealed (e.g., crimp of metal tube or melting of glass tube connected to vacuum pump), the chemically active getter material will absorb reactive residual gases in the FED.

It will be apparent to those skilled in the art that various modifications and variations can be made in the construction, configuration, and/or operation of the present invention without departing from the scope or spirit of the invention. For example, in the embodiments mentioned above, various changes may be made to the particular materials used in the getter structure, whether the materials are considered equivalents or not, without departing from the scope or spirit of the invention. Further, it may be appropriate to make additional modifications, such as to the patterning of the getter structure, and adapting protective layer 440 to comprise the appropriate material, to function as activating means and thus eliminate a separate activating layer like 410, without departing from the scope of the invention. Thus, it is intended that the present invention cover the modifications and variations of the invention provided they come within the scope of the appended claims and their equivalents.

We claim:

1. In a vacuum sealed field emitter display having a first panel connected to a second panel with a perimeter sealing means and having an internal getter, the improvement comprising:

means for activating said getter provided between active elements of said first or second panel;

a layer of getter material overlying said means for activating; and a protective layer overlying said getter layer, wherein said protective layer is adapted to be disrupted by the application of energy to said means for activating.

2. The display of claim 1 wherein said activating means comprises a laser activated means.

3. The display of claim 1 wherein said active elements of said first panel comprise phosphor groups.

4. The display of claim 3 wherein said activating means comprises a criss-cross matrix of activating material between the phosphor groups provided on the first panel.

5. The display of claim 1 wherein said active elements of said second panel comprise groups of field emitters.

6. The display of claim 5 wherein said activating means comprises rows of activating material between gate lines provided on said second panel.

7. The display claim 1 wherein said getter layer comprises:

a layer of getter material of a first type; and a layer of getter material of a second type.

8. The display of claim 7 wherein said getter material of the first type comprises material selected from the group consisting of: iron, zirconium and potassium chromate; and said getter material of the second type comprises material selected from the group consisting of: aluminum zirconium, nickel, and thorium.

9. The display of claim 1 wherein said getter layer comprises material selected from the group consisting of: titanium, nickel, zirconium, thorium, aluminum, and vanadium.

10. The display of claim 1 wherein said protective layer comprises material selected from the group consisting of: aluminum, chromium, titanium, and silicon.

11. The display of claim 1 wherein said activating means comprises a light absorptive array.

12. The display of claim 11 wherein said light absorptive array comprises material selected from the group consisting of: chromium and 50% weight silicon oxide.

13. The display of claim 1 wherein said activating means comprises a resistive heating array.

14. A field emitter display comprising:

a screen panel and field emitter panel connected about their respective perimeters and having an evacuated interior section;

an array of phosphor groups arranged on said screen panel in said evacuated interior section;

a matrix of light absorptive material between said phosphor groups on said screen panel in said evacuated interior section;

a matrix of getter material overlying said light absorptive material in said evacuated interior section; and a matrix of protective material overlying said getter material in said evacuated interior section.

15. The display of claim 14 wherein said getter material comprises:

a layer of getter material of a first type; and a layer of getter material of a second type.

16. The display of claim 15 wherein said getter material of the first type comprises material selected from the group consisting of: iron, zirconium and potassium chromate; and said getter material of the second type comprises material selected from the group consisting of: iron, zirconium, aluminum, thorium, and vanadium.

17. The display of claim 14 wherein said getter material comprises material selected from the group consisting of: titanium, thorium, vanadium, nickel, aluminum, iron, and zirconium.

18. The display of claim 17 wherein said protective material comprises material selected from the group consisting of: aluminum, chromium, and silicon.

19. The display of claim 18 wherein said light absorptive material comprises material selected from the group consisting of: chromium and silicon oxide.

20. The display of claim 14 wherein said matrix of getter material comprises a matrix of dots of getter material.

21. The display of claim 14 wherein said field emitter panel comprises:

an array of field emitter groups arranged on said emitter panel in said evacuated interior section;

an array of light absorptive material between said field emitter groups on said emitter panel in said evacuated interior section;

an array of getter material overlying said light absorptive material in said evacuated interior section; and an array of protective material overlying said getter material in said evacuated interior section.

22. A field emitter display comprising:

a screen panel and a field emitter panel connected about their respective perimeters and having an evacuated interior section;

an array of field emitter groups arranged on said emitter panel in said evacuated interior section;

an array of light absorptive material between said field emitter groups on said emitter panel in said evacuated interior section;

an array of getter material overlying said light absorptive material in said evacuated interior section; and an array of protective material overlying said getter material in said evacuated interior section.

23. The display of claim 22 wherein said getter material comprises material selected from the group consisting of: titanium, aluminum, vanadium, iron, thorium, and zirconium.

24. The display of claim 23 wherein said protective material comprises material selected from the group consisting of: aluminum, chromium, and silicon.

25. The display of claim 24 wherein said light absorptive material comprises material selected from the group consisting of: chromium and silicon oxide.

26. A field emitter display comprising:

a front panel and a back panel connected about their respective perimeters and having an evacuated interior section;

an array of resistive heating elements provided on at least one of said panels in said evacuated interior section;

an array of getter material overlying said resistive heating elements in said evacuated interior section; and an array of protective material overlying said getter material in said evacuated interior section.

27. The display of claim 26 wherein said array of resistive heating elements comprise a matrix of elements between a plurality of phosphor groups on said one of said panels.

28. The display of claim 26 wherein said array of resistive heating elements comprise an array of elements between a plurality of groups of field emitters on said one of said panels.

29. The display of claim 26 further comprising an array of light absorptive material between said resistive heating elements and said one of said panels.

30. In a vacuum sealed display having a first panel connected to a second panel with a perimeter sealing means, an internal getter, means for activating said getter provided between active elements of said first or second panel, and a protective layer overlying said getter, a method of activating said getter comprising the step of:

selectively applying energy from an external source to said activating means such that said protective layer is disrupted by the application of energy and the getter is exposed to the vacuum within said display.

31. The method of claim 30 further comprising the step of drawing a vacuum from said display during the step of selectively applying energy.

32. The method of claim 30 wherein said step of selectively applying energy comprises the step of selectively directing light from an external source to a light absorptive array on said first or second panel.

33. The method of claim 32 wherein the step of selectively directing light comprises the step of raster scanning a laser beam over said light absorptive array.

34. The method of claim 32 wherein the step of selectively directing light comprises the step of spot activation through selective portions of said light absorptive array.

35. The method of claim 32 wherein the step of selectively directing light comprises the step of exposing said light absorptive array to a high intensity flashlamp.

36. The method of claim 30 wherein the step of selectively applying energy comprises the step of applying an electrical current from an external source to a resistive heating array.

37. A method of forming a sealed getter layer overlying a flat panel of a display, comprising the steps of:

providing a thermal activation array on said flat panel;

providing a layer of getter material over said thermal activation array; and providing a layer of protective material over said getter material such that said getter material is encapsulated in said protective material.

38. The method of claim 37 wherein the step of providing a layer of getter material comprises the further steps of:

providing a layer of getter material of a first type; and providing a layer of getter material of a second type.

39. The method of claim 38 wherein said getter material of the first type comprises material selected from the group consisting of: iron, zirconium and potassium chromate; and said getter material of the second type comprises material selected from the group consisting of: iron, zirconium and aluminum.

40. The method of claim 37 wherein said getter material comprises material selected from the group consisting of: titanium, vanadium, aluminum, iron, thorium, and zirconium.

41. The method of claim 37 wherein said protective material comprises material selected from the group consisting of: aluminum, chromium, and silicon.

42. The method of claim 37 wherein said thermal activation array comprises a resistive heating array.

43. The method of claim 37 wherein said thermal activation array comprises a light absorptive array.

44. The method of claim 43 wherein said light absorptive array comprises material selected from the group consisting of: chromium and silicon oxide.

45. The method of claim 37 wherein said layer of getter material comprises a criss-cross matrix of getter material provided between phosphor groupings provided on said flat panel.

46. A method of forming a sealed getter layer overlying one or more transparent regions of a flat panel display substrate, comprising the steps of:

providing a layer of photoresistive material on said substrate;

selectively removing portions of said photoresistive material to expose said transparent regions;

providing a layer of light absorptive material on said photoresistive material and transparent regions;

providing a layer of getter material on said layer of light absorptive material;

providing a layer of protective material on said layer of getter material such that said getter material is encapsulated in said protective material; and lifting off from said substrate, the remaining portions of said photoresistive material and the light absorptive, getter, and protective material overlying the remaining photoresistive material.

* * * * *